US006188852B1

(12) United States Patent
Ojima et al.

(10) Patent No.: US 6,188,852 B1
(45) **Date of Patent: *Feb. 13, 2001**

(54) PROCESS CARTRIDGE AND IMAGE FORMING APPARATUS ON WHICH THE PROCESS CARTRIDGE IS MOUNTABLE

(75) Inventors: Masaki Ojima, Mishima; Takashi Kawana, Yokohama, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/900,836

(22) Filed: Sep. 25, 1997

(30) Foreign Application Priority Data

Jul. 26, 1996 (JP) ..... 8-215191

(51) Int. Cl.[7] ..... G03G 15/00
(52) U.S. Cl. ..... 399/25
(58) Field of Search ..... 399/24–27

(56) References Cited

U.S. PATENT DOCUMENTS

| | | | | |
|---|---|---|---|---|
| Re. 35,751 | * | 3/1998 | Midgley | 399/25 |
| 4,774,544 | * | 9/1988 | Tsuchiya et al. | 399/24 |
| 4,961,088 | * | 9/1988 | Gilliland et al. | 399/25 |
| 5,066,978 | * | 11/1991 | Watarai et al. | 399/24 |
| 5,216,464 | * | 6/1993 | Kotani et al. | 399/24 |
| 5,272,503 | * | 12/1993 | LeSueur et al. | 399/25 |
| 5,283,613 | * | 2/1994 | Midgley, Sr. | 399/9 |
| 5,452,059 | * | 9/1995 | Sekiya | 399/25 |
| 5,572,292 | * | 11/1996 | Chatani et al. | 399/25 |
| 5,771,420 | * | 6/1998 | Suzuki et al. | 399/25 |

* cited by examiner

*Primary Examiner*—William J. Royer
(74) *Attorney, Agent, or Firm*—Fitzpatrick, Cella, Harper & Scinto

(57) ABSTRACT

A process cartridge removably mountable on a body of an image forming apparatus, includes an electrophotographic photosensitive member, a process device acting on the electrophotographic photosensitive member, and a memory storing therein information regarding the process cartridge. It is characterized in that the memory itself stores therein the frequency of writing of information into the memory.

11 Claims, 5 Drawing Sheets

PROCESS CARTRIDGE AND IMAGE FORMING APPARATUS ON WHICH THE PROCESS CARTRIDGE IS MOUNTABLE

BACKGROUND OF THE INVENTION

1. Field of the Invention

This invention relates to a process cartridge and an image forming apparatus. Here, the term "image forming apparatus" covers, for example, an electrophotographic copying apparatus, an electrophotographic printer (e.g. an LED printer, a laser beam printer or the like), electrophotographic facsimile apparatus and an electrophotographic word processor.

Also, the term "process cartridge" refers to a combination of charging means, developing means or cleaning means and an electrophotographic photosensitive member integrally made into a cartridge which is removably mountable with respect to an image forming apparatus body, or a combination of at least one of charging means, developing means, and cleaning means and an electrophotographic photosensitive member integrally made into a cartridge which is removably mountable with respect to an image forming apparatus body, or a combination of at least developing means and an electrophotographic photosensitive member integrally made into a cartridge which is removably mountable with respect to an image forming apparatus body.

2. Related Background Art

In an image forming apparatus using the electrophotographic image forming process, there has heretofore been adopted a process cartridge system in which an electrophotographic photosensitive member and process means acting on this electrophotographic photosensitive member are integrally made into a cartridge which is removably mountable with respect to the image forming apparatus body. According to this process cartridge system, the maintenance of the apparatus can be done not by a serviceman, but by a user himself and therefore, the operability of the apparatus can be markedly improved. So, this process cartridge system is widely used in electrophotographic image forming apparatuses.

FIG. 5 of the accompanying drawings is a cross-sectional view showing an image forming apparatus on which a process cartridge according to the prior art is mountable, and shows an electrophotographic recording apparatus used as the engine of a copying apparatus or a page printer.

As shown in FIG. 5, a photosensitive drum (electrophotographic photosensitive member) 102, a charging roller (charging means) 103 and cleaning means 114 including a cleaning blade are made integrally with one another and constructed into a process cartridge (latent image process cartridge) 115, which is removably mountable with respect to an image forming apparatus body 101 through mounting means 122.

The photosensitive drum 102 is rotated in one direction about the axis thereof, and the surface of the photosensitive drum 102 is uniformly charged by a bias comprising an alternating current superposed on a direct current being applied thereto from a bias power source 104 connected to the charging roller 103. The uniformly charged photosensitive drum 102 is suitably exposed to light by an exposure device 105, so that an electrostatic latent image is formed on the surface of the photosensitive drum.

A developing device 106 is installed at a slight distance from the photosensitive drum 102, and the latent image formed on the surface of the photosensitive drum 102 is developed by the developing device 106 by the use of a developer 107 and is visualized as a toner image. The thus obtained toner image is transferred to a transfer material 110 by a transfer charger 109. The transfer material 110 is supplied from a sheet supply cassette 120 by a sheet supply roller 111, and is sent to the transfer charger 109 in synchronism with the toner image on the photosensitive drum 102 by register rollers 112.

The toner image transferred to the transfer material 110 is conveyed to a fixating device 113 with the transfer material 110 to be fixated by pressure and becomes a recorded image. On the other hand, any developer untransferred and left on the photosensitive drum 102 is removed by a cleaning blade made of an elastic material forming cleaning means 114 which is in contact with the photosensitive drum 102. The photosensitive drum 102 from which the untransferred developer has been removed is again subjected to uniform charging on the surface thereof by the charging roller 103, and the above-described process is repeated.

In such an image forming apparatus, in order to facilitate the maintenance of the apparatus, a process cartridge provided by several process elements combined together or by a single process element is sometimes made easily mountable and dismountable with respect to the apparatus. The latent image process cartridge of FIG. 5 of the accompanying drawings, i.e., a process cartridge 115 comprising the photosensitive member 102, the charging roller 103 and the cleaning means 114 made integral with one another, is an example of a combination of process elements. As an example of the single process element, there is the developing device 106 of FIG. 5 made into a developing process cartridge 116.

Of course, the combination of the process elements constituting the process cartridge is not limited to the above-described examples, but is free. Also, the latent image process cartridge 115 and a developing process cartridge 116 may be made integral with each other by frame members 117 and 118 to be made into a cartridge removably mountable with respect to the apparatus body 101.

In an image forming apparatus provided with such process cartridge, it is often the case that the nominal life of the cartridge is defined as a standard and can ensure the quality of each process cartridge, because the process cartridge is replaced when this nominal life is exceeded. In many cases, the nominal life of a process cartridge is indicated by a simple value, such as a maximum number of supplied sheets, and there has been adopted a system for warning the user when the replacement is reached by a counter or the like in the apparatus body.

However, with the advance of the function of the image forming apparatus, the form of print, i.e., the form of image formation, has become complicated (for example, image formation on both an A3 sheet and an A4 sheet is effected or a plurality of developing devices are interchanged to thereby effect multi-color image formation), and depending on the situation of use, the maximum number of supplied sheets for the process cartridge has varied greatly.

Therefore, there has been proposed a system in which the life of the cartridge is not prescribed by the conventional nominal life, but there is provided an element for storing life detection parameters, such as the integrated number of printed sheets for the process cartridge, the driving time and the electrical energization time, and the cartridge life is determined on the basis of these data. There has further been proposed a system in which a memory element, such as a non-volatile memory, is carried on a process cartridge itself, so that the cartridge life can be detected more accurately even if the cartridge is interchanged in its course of use.

Also, there are some irregularities in the physical characteristics and variations in characteristics by use in the constituents of the process cartridge. Therefore, there has been proposed a system in which an element for storing the physical characteristic of the individual constituents therein is provided in the process cartridge itself and correction is applied to image forming conditions by the image forming apparatus body. Again in this case, hysteresis such as the driving time, the electrical energization time and the integrated amount of current are sometimes stored in a memory element so that fine correction of the image forming conditions may be effected.

Now, recently, from the viewpoint of the effective utilization of natural resources, used process cartridges have been collected and reused, and cartridges carrying the memory elements therein as described above have been recycled bodily with the memory elements.

Generally, however, a memory element is limited in write-in frequency, and writing-in exceeding a prescribed frequency defined for each kind of memory element spoils the reliability of the contents of memory. When the contents of the memory deteriorate, not only do the life of the process cartridge and the image forming conditions deteriorate, but also in the worst case, the image forming apparatus body may be spoiled or get out of order.

SUMMARY OF THE INVENTION

It is an object of the present invention to provide a process cartridge which enables the reliability of the memory content of a memory element to be guaranteed even if the process cartridge is recycled, and to provide an image forming apparatus.

It is another object of the present invention to provide a process cartridge having an electrophotographic photosensitive member, process means acting on this electrophotographic photosensitive member, and memory means storing therein information regarding the process cartridge, characterized in that the memory means itself stores therein the frequency of writing of information into the memory means, and an image forming apparatus on which the cartridge is mountable.

Further objects of the present invention will become apparent from the following detailed description when read with reference to the accompanying drawings.

DESCRIPTION OF THE PREFERRED EMBODIMENTS

Some embodiments of the present invention will hereinafter be described in detail with reference to the drawings.

Embodiment 1

Figure 1:
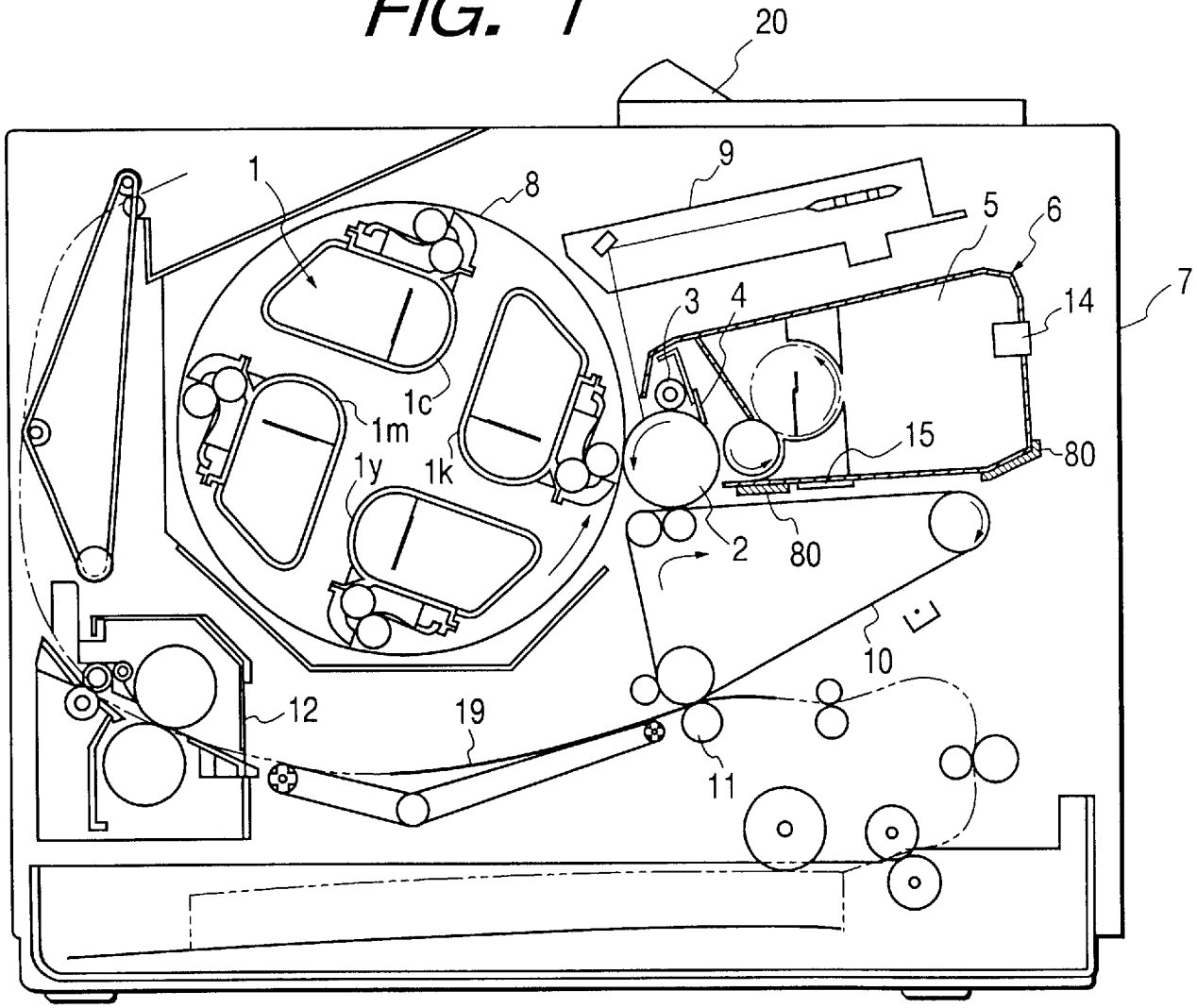
FIG. 1 is a schematic cross-sectional view showing an embodiment of the image forming apparatus of the present invention.

FIG. 1 is a cross-sectional view showing an embodiment of an image forming apparatus on which a process cartridge according to the present invention is mountable, and shows a color laser beam printer.

The color laser beam printer is provided with developing process cartridges 1 of four colors (1*y*, 1*m*, 1*c* and 1*k*) and a process cartridge 6 having a photosensitive drum 2 or the like. The printer is further provided with a rotary drum 8, a laser exposure device 9, an intermediate transfer belt 10 which is an intermediate transfer member, a secondary transfer roller 11 and a fixating device 12. This printer 7 adopts a system in which toner images of four colors are superposed upon one another on the transfer belt 10 to thereby form a full color image.

Figure 2:
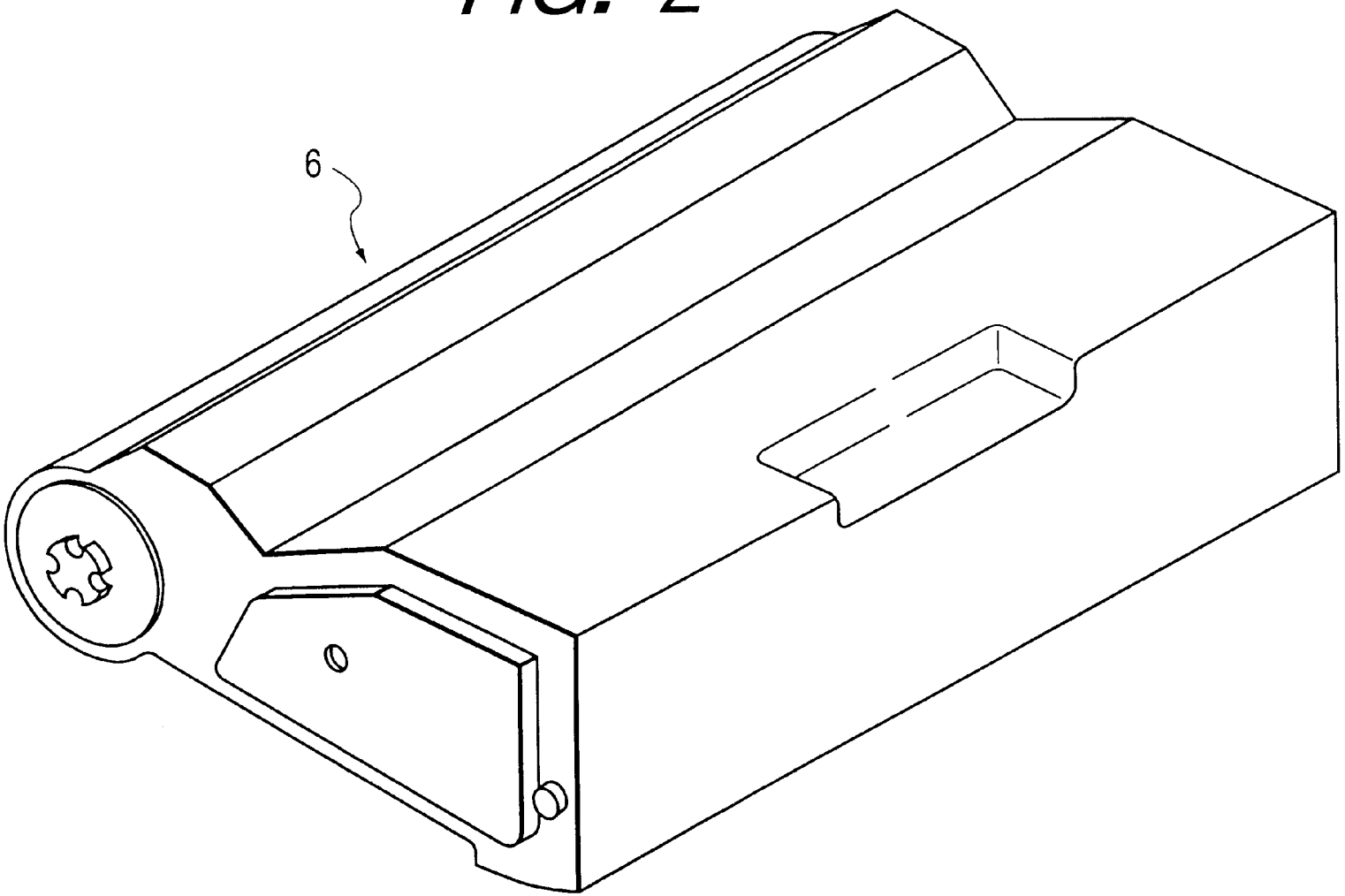
FIG. 2 is a pictorial perspective view of the process cartridge of FIG. 1.
Figure 3:
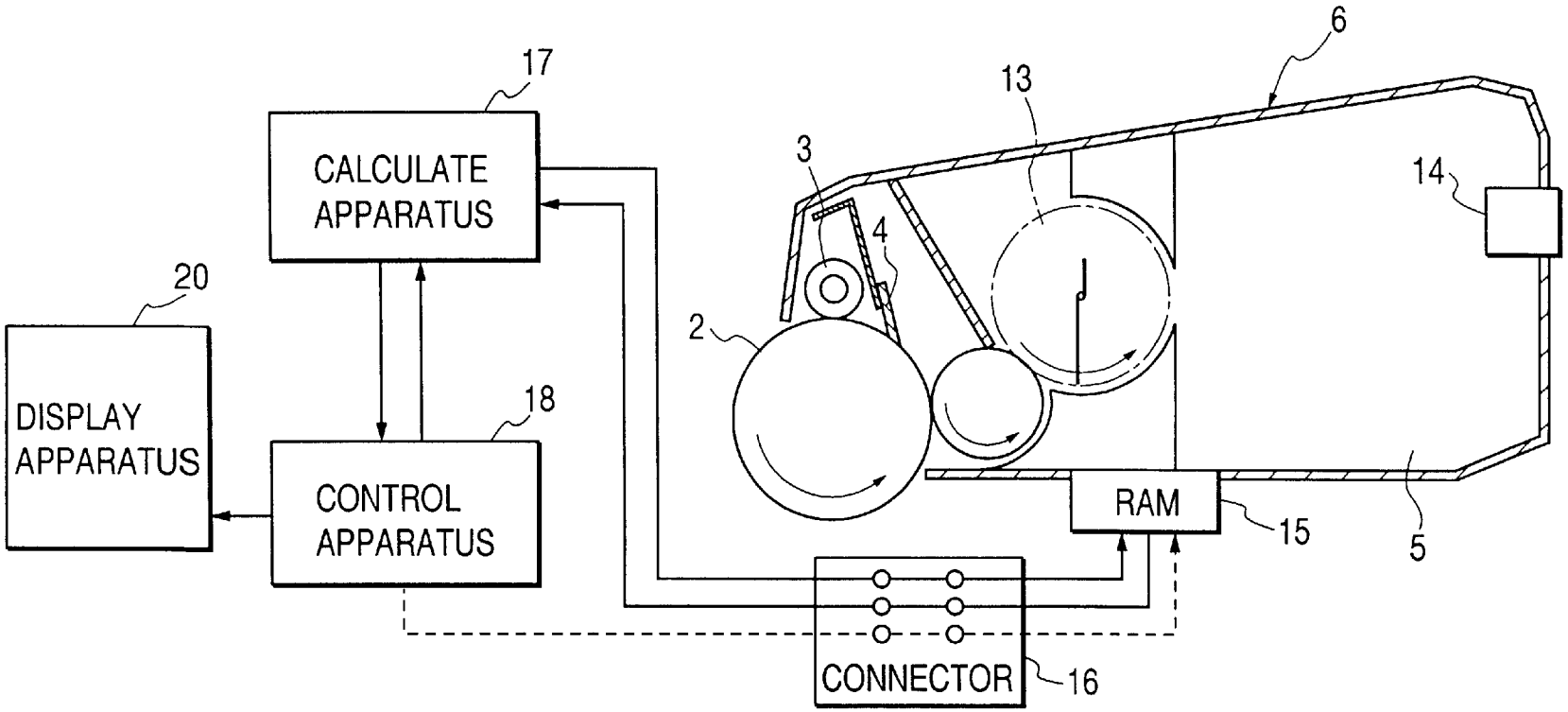
FIG. 3 illustrates the driving of the process cartridge of FIG. 1.

The process cartridge 6 comprises the photosensitive drum 2, a charging roller 3, a cleaning blade 4 constituting cleaning means, and a waste toner box 5 made integral with one another, to be formed into an appearance as shown in FIG. 2, and it is removably mountable with respect to the image forming apparatus body 7 through mounting guide means 80 as shown in FIG. 1.

The shapes of the four developing process cartridges 1 are the same irrespective of the colors of toners, and the process cartridges 1 slide laterally relative to the rotary drum 8 carrying them thereon, so that they are easily removably mountable with respect to the printer body 7. The developing cartridges 1 are successively conveyed to a developing position opposed to the photosensitive drum 2 by the rotation of the rotary drum 8. Positions corresponding to the respective developing cartridges 1 are designated on the rotary drum 8. The process cartridge 6 also slides laterally relative to the printer body 7 through the mounting means 80, so that it is easily removably mountable with respect to the printer body.

The photosensitive drum 2 is formed by a cylindrical aluminum cylinder having a plurality of photosensitive layers applied thereto. The charging roller 3 has an electrically conductive elastic layer of a volume resistivity of the order of $10^8$ to $10^{10}$ ωcm around a mandrel, and is adapted to rotate with the rotation of the photosensitive drum 2 while being in contact with the photosensitive drum 2.

The cleaning blade 4 comprises an elastic member of urethane rubber, and is always urged against the photosensitive drum 2 with predetermined pressure and mechanically scrapes off any untransferred toners remaining on the photosensitive drum 2. The waste toners scraped off by the cleaning blade 4 are sent to the waste toner box 5 by a conveying mechanism 13 in the process cartridge 6.

The waste toner box 5 occupies most of the volume of the process cartridge 6. A waste toner amount detecting mechanism 14 is installed in this waste toner box 5, and when the waste toner box 5 becomes nearly full of the waste toners, it is used to control the printer body 7 so that a new image forming operation may not be entered. A RAM 15 as non-volatile memory means is carried on the waste toner box 5, and when mounted on the printer body 7, it is connected to a calculating device (calculating circuit) 17 in the printer body through a connector 16 so that the reading-out/writing-in of data can be done.

The calculating device 17 is connected to the control apparatus (control circuit) 18 of the printer body 7 and effects the exchange of data with the RAM 15 of each process cartridge on the basis of the command of the control apparatus. In the present embodiment, the degree of consumption of the photosensitive drum 2 is stored in the RAM 15 of the process cartridge 6, so that the detection of life is effected.

A description will hereinafter be provide of the image forming process of the laser beam printer 7 according to the present embodiment.

A charging bias is applied to the charging roller 3 between it and the photosensitive drum 2 by a charging bias voltage source (not shown), so that the surface of the photosensitive drum 2 is substantially uniformly charged. The charged surface of the photosensitive drum 2 is scanned and exposed by an infrared laser beam outputted from the laser exposure device 9. This laser beam corresponds to a pixel signal based on image information resolved into four colors, i.e., yellow (y), magenta (m), cyan (c) and black (k), and in this order, electrostatic latent images are formed on the surface of the photosensitive drum.

The formed electrostatic latent images are developed at the developing position by the developing process cartridges 1. Prior to this development, the developing process cartridge 1y of the color corresponding to the color-separated image (yellow at first) is conveyed to the developing position by the rotary drum 8 being rotated. When the electrostatic latent image on the photosensitive drum 2 passes the developing position, a developing bias is applied from the developing bias voltage source to the developing process cartridge 1, so that the latent image is developed.

The yellow toner image obtained by developing the yellow color-separated image is transferred onto the intermediate transfer belt 10 (primary transfer). The intermediate transfer belt 10 is urged against the photosensitive drum 2 with a predetermined pressure force, and is rotatively driven at a portion opposed to the photosensitive drum 2 in the same direction and at the same peripheral velocity as the photosensitive drum. A primary transfer bias is applied to the intermediate transfer belt 10 between it and the photosensitive drum 2 by a primary transfer bias voltage source (not shown), so that the yellow toner image is transferred onto the intermediate transfer belt 10 by it.

Likewise, a magenta toner image is formed on the photosensitive drum 2 via the charging, exposing and developing steps, and the magenta toner image is transferred onto the intermediate transfer belt 10 while being superposed on the already formed yellow toner image without color misregistration. Likewise, a cyan toner image and a black toner image are successively transferred onto the intermediate transfer belt 10 while being superposed on the yellow and magenta toner images, so that a full color image comprising the toner images of four colors superposed on one another is formed on the intermediate transfer belt 10. Any untransferred toners remaining on the photosensitive drum 2 by the transfer are removed from the photosensitive drum 2 by the cleaning blade 4.

The full color image on the intermediate transfer belt 10 is secondarily transferred onto a transfer material 19 by a secondary transfer roller 11. The secondary transfer roller 11 is spaced apart from the intermediate transfer belt 10 until the full color image is formed, and is brought into contact with the intermediate transfer belt 10 immediately before the full color image is formed and arrives at a secondary transfer position. Substantially simultaneously with this contact, a secondary transfer bias is applied between the secondary transfer roller and the intermediate transfer belt 10 with the transfer material conveyed being interposed therebetween by a secondary transfer bias voltage source, not shown, so that the full color image is transferred onto the transfer material 19. The transfer material 19 onto which the full color image has been transferred is conveyed to the fixating device 12, where the full color image is fixated by heat and pressure and becomes a recorded image.

What has been described above is a series of full color image forming steps, and when a plurality of images are to be formed, the above-described series of steps are repeated. Of course, when a monochromatic character image is to be formed, only the black developing process cartridge is used from the first and the steps of superposing other colors are omitted.

In the present embodiment, the photosensitive drum 2 has on its surface a plurality of photosensitive layers of about 40 $\mu$m functionally separated and laminated, and the uppermost charge transport layer of the photosensitive layers has an initial thickness of about 25 $\mu$m. When, due to the discharge deterioration during charging and to the friction of the cleaning blade 4, the charge transport layer is consumed and the thickness thereof is decreased to 13 $\mu$m or less, the charges charged on the surface of the photosensitive drum will leak through the charge transport layer to rapidly cause a deterioration in the quality of the image.

In a printer like the present embodiment wherein both multi-color image formation and monochromatic image formation can be effected, the degree of consumption of the charge transport layer of the photosensitive drum 2 differs as a matter of course between a case where a sheet of full color image is formed and a case where a sheet of monochromatic image is formed. Also, there is provided a sequence of cleaning for removing the toner stains of the photosensitive drum 2 and the intermediate transfer belt 10 before and after image formation and therefore, the degree of consumption per sheet of image formation is considered to differ between a case where image formation is continuously effected and a case where image formation is intermittently effected.

In the present embodiment, image formation tests were carried out in three image forming modes and the formation frequency of each latent image, the number of supplied sheets and the integrated driving time until the degree of consumption of the charge transport layer of the photosensitive drum became 12 $\mu$m were examined. The results are shown in Table 1 below.

The image forming modes are as follows:

Mode1: monochromatic images are intermittently formed on a sheet, one by one.

Mode2: full color images of four colors are intermittently formed on a sheet, one by one.

Mode3: monochromatic images are intermittently formed ten sheets by ten sheets.

TABLE 1

| Image forming mode | Latent image formation frequency | Number of supplied sheets | Integrated driving time | write-in frequency |
|---|---|---|---|---|
| Monochrome/ 1 sheet | 13,350 times | 13,350 sheets | 267,100 s | 13,350 times |
| Full color (4 colors)/ 1 sheet | 30,120 times | 7,530 sheets | 263,500 s | 7,530 times |

TABLE 1-continued

| Image forming mode | Latent image formation frequency | Number of supplied sheets | Integrated driving time | write-in frequency |
|---|---|---|---|---|
| Monochrome/ 10 sheets continuous | 43,600 times | 43,600 sheets | 261,400 s | 4,360 times |

In the present embodiment, the driving time of the photosensitive drum 2 required to form one A4 sheet of latent image is about 5.0 sec., and the cleaning time necessary before and after image formation is about 7.5 sec. The frequency of writing into the RAM 15 has been such that writing-in is effected each time a series of image forming operations are terminated.

As shown in Table 1, in different image forming modes, both the latent image formation frequency and the number of supplied sheets differ greatly, but the integrated driving time of the photosensitive drum 2 is substantially the same in any one of the modes, and it is seen that the integrated driving time is suitable as the parameter of the degree of consumption of the photosensitive drum.

As previously described, the frequency of writing into the RAM 15 is limited and it is impossible to recycle limitlessly. When the content of memory gets out of order, not only the life of the process cartridge becomes unknown, but there is the possibility of the printer body being spoiled and/or going wrong due to bad charging or leakage of the photosensitive drum. The manufacturer's guaranteed value of the frequency of writing into the RAM 15 used in the present embodiment is about 100,000 times at room temperature. It becomes smaller in a high-temperature environment, and in the interior of the apparatus body in which the temperature is 40 to 50° C., about 80,000 times is judged to be the limit.

In Table 1, there is shown the write-in frequency in each time forming mode up to the life of the process cartridge 6 when the writing into the RAM 15 was effected each time a series of image forming operations was terminated. From Table 1, it can be said that the standard value of the write-in frequency effected up to the life of the process cartridge 6 according to the present embodiment is about 10,000 times.

Thus, in the present embodiment, the upper limit of the integrated driving time up to the life of the photosensitive drum 2 was determined, and each time a series of image forming operations are started/terminated, the driving time of the photosensitive drum 2 was subtracted from the upper limit value of the integrated driving time, so that the life of the photosensitive drum 2 was detected. Also, the upper limit of the frequency of writing into the RAM 15 was determined, and whether the next recycle of the process cartridge 6 was possible or not was displayed so as to be known to the user as well.

Figure 4:
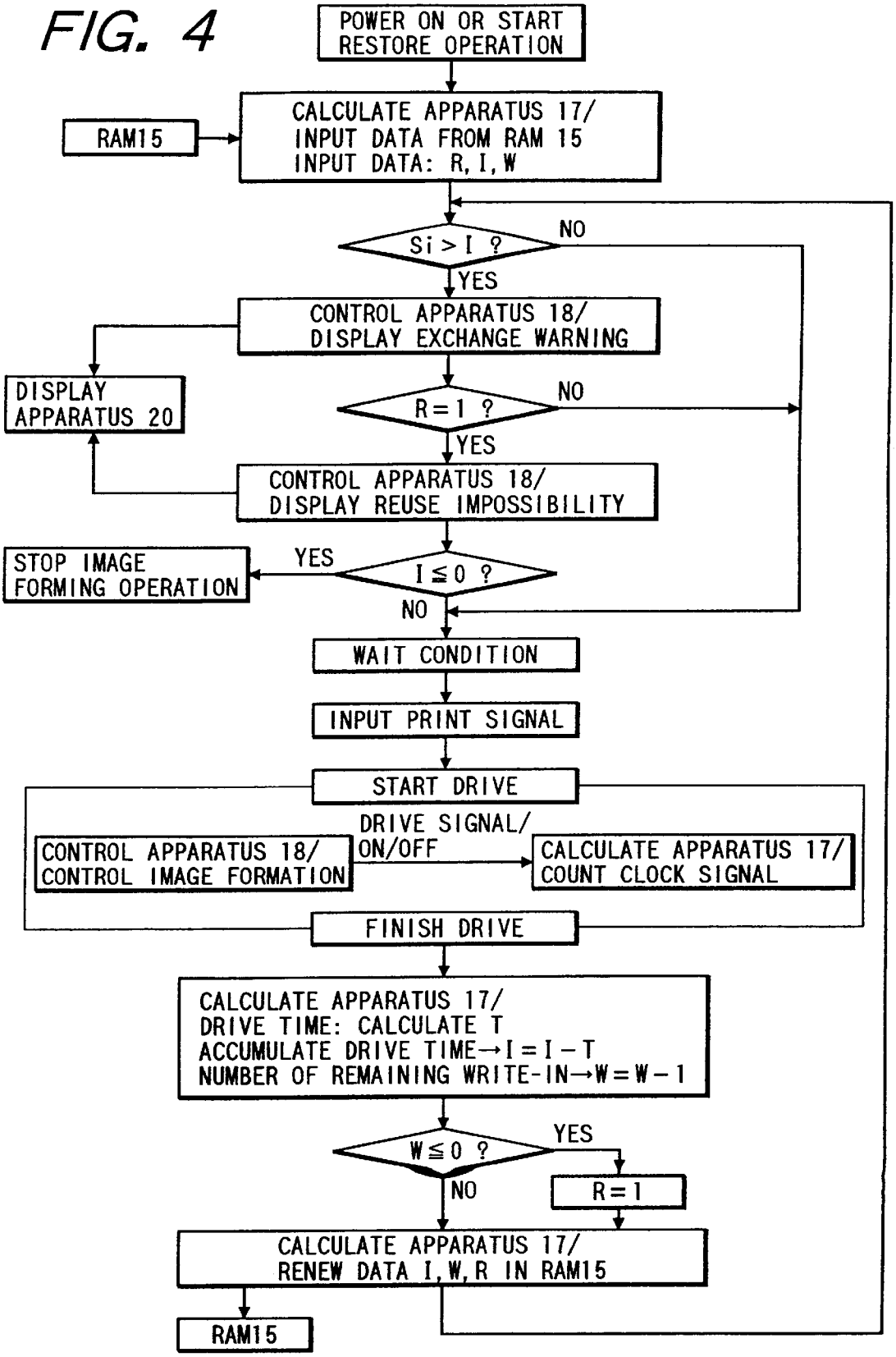
FIG. 4 is a flow chart showing a sequence for effecting the judgment of the interchange of a photosensitive drum in the image forming apparatus of FIG. 1 and the judgment of the propriety of recycling of the process cartridge.
Figure 5:
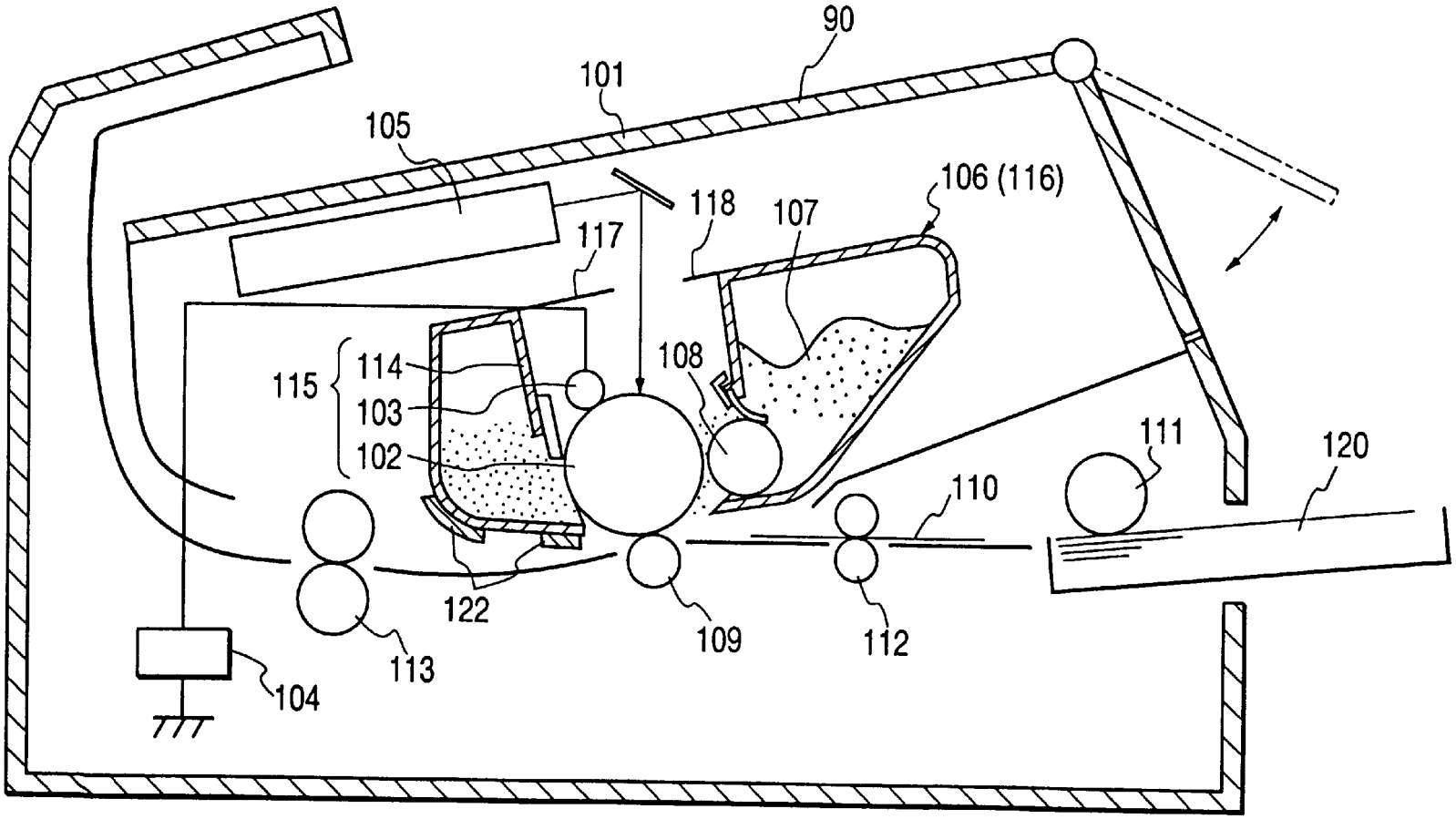
FIG. 5 PRIOR ART
FIG. 5 is a schematic cross-sectional view showing an image forming apparatus according to the prior art.

A description will hereinafter be made of the operation of effecting the judgment of the interchange of the photosensitive drum 2 and the judgment of the propriety of the recycle of the process cartridge 6 by the use of the sequence shown in FIG. 4.

First, during the manufacture of the process cartridge 6, integrated driving time data I conforming to the photosensitive drum 2, the number of remaining write-in data W of the RAM 15 and recycle possibility judging flag R are inputted to the RAM 15. In the present embodiment, I=260,000 sec. and W=70,000 times are inputted as an initial value to thereby bring about R=0 (OFF/reusable). Also, when the photosensitive drum 2 is to be interchanged and recycled, the integrated driving time data I alone is renewed and the number of remaining write-in data W and the recycle possibility judging flag R are not renewed.

Upon switching on of a power source or restoring operation after the mounting of the process cartridge 6, the control apparatus 18 renders the calculating apparatus 17 capable of receiving data, and reads and memorizes the integrated driving time data I of the RAM 15, the number of remaining write-in data W of the RAM 15 and the recycle possibility flag R into the calculating apparatus 17.

Subsequently, the control apparatus enters the judging operation. In the calculating apparatus 17, the integrated driving time data I is compared with a predetermined exchange warning threshold value Si. Then, whether the recycle possibility judging flag R is 0 (OFF/reusable) or 1 (ON/unusable) is judged. If the integrated driving time data I of the photosensitive drum 2 is smaller than the threshold value Si, the control apparatus 18 puts out the display of "exchange warning" of the process cartridge 6 to the display apparatus 20. In the present embodiment, the exchange warning threshold value Si is 3,500 sec. Further, when the flag R is 1, the control apparatus puts out the display of "unreusability" of the process cartridge 6 to the display apparatus 20. Subsequently, when the integrated driving time data I is 0 or less, the printer body is controlled so as not to enter a new image forming operation.

When the above-described judging operation is finished, the printer body assumes the ordinary print waiting condition.

When a printing signal is inputted to the printer body, the printer body enters a series of image forming operations. The control apparatus 18 causes the calculating apparatus 17 to count the clock signals from the start of the driving of the photosensitive drum 2 till the end of the driving, and enters the following calculating operation from immediately after the termination of the image forming operations. The control apparatus 18 reads out the above-mentioned count number in the calculating apparatus 17, and causes the latter to calculate the driving time T (sec.). Subsequently, the calculating apparatus 17 subtracts the calculated driving time T from the integrated driving time data I. The value obtained by the subtraction is renewed as new integrated driving time data I. Subsequently, 1 is subtracted from the number of remaining write-in data W. Next, whether the number of remaining write-in data W is 0 is judged. If the number of remaining write-in data W is 0 or less, the flag R is changed to 1 (ON/unusable).

After the termination of the above-described calculation, the control apparatus 18 renews the content of the RAM 15 in the process cartridge 6 by the integrated driving time data I of the calculating apparatus 17, the number of remaining write-in data W of the RAM 15 and the recycle possibility judging flag R.

Subsequently, the control apparatus enters the afore-described judging operation, and the printer body assumes the ordinary print waiting condition unless the integrated driving time data I of the calculating apparatus becomes 0 or less.

In the above-described sequence, when the frequency of writing into the RAM 15 reaches 70,000 times and the life of the photosensitive drum 2 in the process cartridge 6 is exhausted, the "unreusability" of the process cartridge 6 is displayed. As previously described, the standard write-in frequency up to the life of the process cartridge 6 according to the present embodiment is considered to be about 10,000 times and therefore, even if the process cartridge is recycled immediately before the write-in frequency reaches 70,000 times, the "unreusability" of the process cartridge 6 is displayed for the write-in frequency of about 80,000 times. Thus, the content of the memory of the data can be guaranteed reliability.

As described above, by limiting the frequency of data writing into the RAM 15, there can be provided a process cartridge which can more accurately maintain the control accuracy of cartridge life detection or the like even when the process cartridge is recycled.

The gist of the present invention resides in causing a memory element for effecting the detection of the life of the constituents of the process cartridge or a memory element storing the image forming conditions of the process cartridge therein to store the write-in frequency of the memory element itself, thereby guaranteeing the reliability of the contents of the memory of the memory element even if the process cartridge is recycled.

In the present embodiment, whether the next recycle of the process cartridge is possible is displayed so as to be known to the user as well, but even if such display is omitted, it will not be against the gist of the present invention if the judgment as to whether the process cartridge is reusable or not is possible during the recycle.

While in the present embodiment, the process cartridge has been described, the present invention is not restricted thereto, but can also be applied to a process cartridge in any interchangeable form, for example, a developing process cartridge. In the present embodiment, it will suffice if the process cartridge carries thereon a memory element storing therein the write-in frequency of the memory element itself.

Further, while in the present embodiment, the detection of the life of the process cartridge has been described, this is not restrictive, and the invention also applies to a case where the image forming conditions are controlled on the basis of the data of the memory element. For example, data about the physical characteristics of the constituents of the process cartridge and the hysteresis of the image forming conditions will also be considered within the scope of the gist of the present invention if the process cartridge carries thereon a memory element storing the write-in frequency of the memory element itself therein. Of course, the memory element is not restricted to the RAM, but can be a memory element capable of suitably rewriting data.

While the present invention has been described with respect to an image forming apparatus in which the photosensitive drum, etc. are made into a cartridge, the present invention can equally be applied to an image forming apparatus of a type in which the photosensitive drum, etc. are not made into a cartridge.

As described above, according to the present invention, a memory element for effecting the detection of the life of the constituents of a process cartridge or a memory element storing therein the hysteresis of the image forming conditions of the process cartridge is made to store therein the frequency of writing into the memory element itself. Therefore, when the process cartridge is to be recycled, the reliability of the content of the memory of the memory element can be guaranteed by referring to the write-in frequency and the recycling of the process cartridge can be accomplished.

What is claimed is:

1. An image forming apparatus, comprising:

an image forming device configured to form an image on a recording medium;

a memory, connected to said image forming device, wherein said memory stores information relating to an amount of use of said image forming device; and a writing device, connected to said memory, said writing device writing the information into said memory;

wherein, when said image forming device performs an image formation operation on a sheet of the recording medium, said writing device writes the information into said memory when the image formation operation is finished, wherein when said image forming device performs image formation operations on plural sheets of the recording medium continuously, said writing device writes the information into said memory when the image formation operations of the plural sheets of the recording medium are finished, and wherein said memory further stores therein a frequency of writing operations for writing information into said memory.

2. An image forming apparatus according to claim 1, wherein said image forming device is composed of a plurality of components and wherein at least one of the components of said image forming device and said memory form a unit, with said unit being detachably attachable to a main body of said apparatus.

3. An image forming apparatus according to claim 2, wherein said image forming device includes an image bearing member, a charger configured and positioned to charge said image bearing member, an image writer configured and positioned to form a latent image on said image bearing member in accordance with image information, a developer configured and positioned to develop the latent image, a transferer configured and positioned to transfer the developed image to the recording medium, and a cleaner configured and positioned to clean said image bearing member.

4. An image forming apparatus according to claim 1, wherein said memory further stores information showing whether said image forming device reaches the end of its life or not.

5. A cartridge removably mountable on a main body of an image forming apparatus, comprising:

at least one component of an image forming device configured and positioned to form an image on a recording medium in a printing operation; and a memory, connected to said image forming device, wherein said memory stores information relating to an amount of use of said image forming device;

wherein said memory further stores therein a frequency of writing operations for writing information into said memory, wherein the frequency of writing operations for writing information is a value that is different from the number of printing operations.

6. A cartridge according to claim 5, wherein said at least one component includes at least one of an image bearing member, a charger configured and positioned to charge said image bearing member, a developer configured and positioned to develop a latent image formed on said image bearing member, and a cleaner configured and positioned to clean said image bearing member.

7. An cartridge according to claim 5, wherein said memory further stores information showing whether said image forming device reaches the end of its life or not.

8. A cartridge removably mountable on a main body of an image forming apparatus, comprising:

at least one component of an image forming device configured and positioned to form an image on a recording medium; and a memory, connected to said image forming device, said memory storing information relating to an amount of use of said image forming device, wherein said memory further stores therein a frequency of writing operations for writing information into said memory and information which can limit the frequency of writing operations for writing information.

9. A cartridge according to claim 8, wherein said at least one component includes at least one of an image bearing member, a charger configured and positioned to charge said image bearing member, a developer configured and positioned to develop a latent image formed on said image bearing member, and a cleaner configured and positioned to clean said image bearing member.

10. A cartridge removably mountable on a main body of an image forming apparatus, comprising:

at least one component of an image forming device configured and positioned to form an image on a recording medium; and a memory for storing information relating to an amount of use of said image forming device, wherein said memory further stores therein a frequency of writing operations for writing information into said memory and information indicating whether recycling is possible or not.

11. A cartridge according to claim 10, wherein said at least one component includes at least one of an image bearing member, a charger configured and positioned to charge said image bearing member, a developer configured and positioned to develop a latent image formed on said image bearing member, and a cleaner configured and positioned to clean said image bearing member.

* * * * *

UNITED STATES PATENT AND TRADEMARK OFFICE

CERTIFICATE OF CORRECTION

PATENT NO. : 6,188,852 B1
DATED : February 13, 2001
INVENTOR(S) : Masaki Ojima, et al.

It is certified that error appears in the above-identified patent and that said Letters Patent is hereby corrected as shown below:

Title page,
Item [56] References Cited, U.S. Patent Documents
"4,961,088 9/1988 Gilliland et al." should read
-- 4,961,088 10/1990 Gilliland et al. --.

Column 1,
Line 21, "means" should read -- means, --.

Column 3,
Line 7, "characteristic" should read -- characteristics --.

Column 4,
Line 41, "ωcm" should read -- Ωcm --.

Column 5,
Line 4, "provide" should read -- provided --.

Column 7,
Line 28, "content" should read -- contents --.
Line 59, "recycle" should read -- recycling --.

Column 9,
Line 19, "recycle" should read -- recycling --.
Line 24, "recycle." should read -- recycling. --.

UNITED STATES PATENT AND TRADEMARK OFFICE

CERTIFICATE OF CORRECTION

PATENT NO. : 6,188,852 B1
DATED : February 13, 2001
INVENTOR(S) : Masaki Ojima, et al.

It is certified that error appears in the above-identified patent and that said Letters Patent is hereby corrected as shown below:

Column 10,
Line 2, "memory;" should read -- memory, --.
Line 45, "device;" should read -- devices, --.
Line 59, "An" should read -- A --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*